United States Patent [19]

Anderson, Jr.

[11] 4,184,502

[45] Jan. 22, 1980

[54] SHADE APPARATUS

[76] Inventor: Byron Anderson, Jr., P.O. Box 1124, Highlands, Tex. 77502

[21] Appl. No.: 932,439

[22] Filed: Aug. 10, 1978

[51] Int. Cl.[2] ..... A45B 15/00; A45B 23/00

[52] U.S. Cl. ..... 135/20 R; 135/1 D; 135/2; 135/34

[58] Field of Search ..... 135/5 R, 20 R, 33 R, 135/34, 2

[56] References Cited

U.S. PATENT DOCUMENTS

| | | | |
|---|---|---|---|
| 519,178 | 5/1894 | Austin | 135/5 R |
| 1,066,061 | 7/1913 | Taylor | 135/20 R |
| 2,577,317 | 12/1951 | Eschrich | 135/20 R |
| 2,671,458 | 3/1954 | Goldstein | 135/20 R |
| 3,863,660 | 2/1975 | Glaeser | 135/34 |

*Primary Examiner*—Reinaldo P. Machado
*Attorney, Agent, or Firm*—Bernard A. Reiter

[57] ABSTRACT

A lightweight shade apparatus constructed of a plurality of intersecting ribs extending radially outwardly, the ribs being covered by bowed cross members adapted to fit over the ribs and to be affixed thereto by a cooperating circumferential belt, the belt functioning also to secure a covering over the top of the bowed cross members.

5 Claims, 10 Drawing Figures

SHADE APPARATUS

BACKGROUND OF THE INVENTION

BRIEF DESCRIPTION

This invention relates in general to umbrellas and weather protectors in general, and more particularly to a plurality of umbrella components, preferably made from plastic, and which may include a fabric or transculent sheet fabric or the like type of canopy and which may be quickly and easily assembled and disassembled by the user thereof.

Conventional umbrellas require the mechanical assembly of numerous parts made to close mechanical tolerances and because of the precise operation required includes inherent weaknesses in the ribs and other structures. Commonly, such other umbrellas are prone to being turned inside out and are easily damaged or even destroyed as a consequence of adverse weather. More importantly, conventional umbrellas are rather fragile because they are made of an interacting association of thin metal wires and springs and are often placed in such severe tension when deployed that the slightest contact with the fabric thereof will produce a tear.

Still further, the metal assembly of conventional umbrellas requires numerous special metal forming tools for parts and costly time expenditures for assembly. The present invention is easily made in quantity from molded plastic parts which may, with facility, be securely snapped together and which is possessed of marked structural integrity even in extremely adverse weather and severe winds. Still further, the umbrella of the present invention may be readily deployed and disassembled by simply removing a single flexible strip, subsequent to which the umbrella is easily taken apart and packaged as a plurality of elongate, but sturdy wood, plastic or metal pieces.

BRIEF DESCRIPTION OF THE DRAWINGS

These and numerous other features and advantages of the invention will become readily apparent upon a reading of the detailed description, claims and drawings hereinafter, wherein like numerals denote like parts in the several views and wherein:

FIG. 1 illustrates an elevation view of the invention designed and deployed, in exemplary form as a shade umbrella for the beach or like.

DETAILED DESCRIPTION

Figure 1:
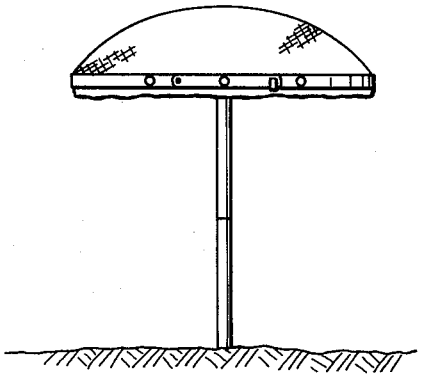
Figure 2:
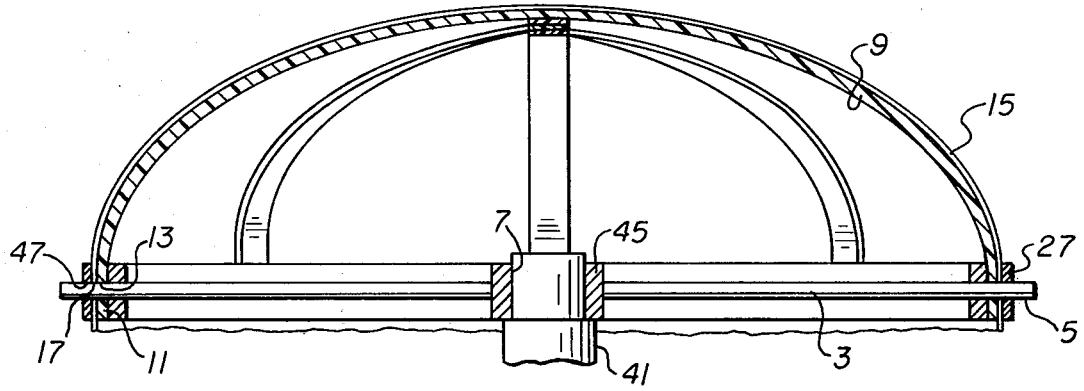
FIG. 2 is a vertical sectional view through the umbrella of FIG. 1.
Figure 4:
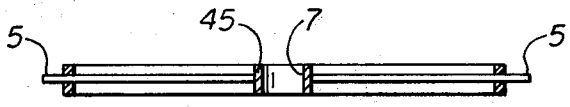
FIG. 4 is a view through the plane 4—4 of FIG. 3.
Figure 3:
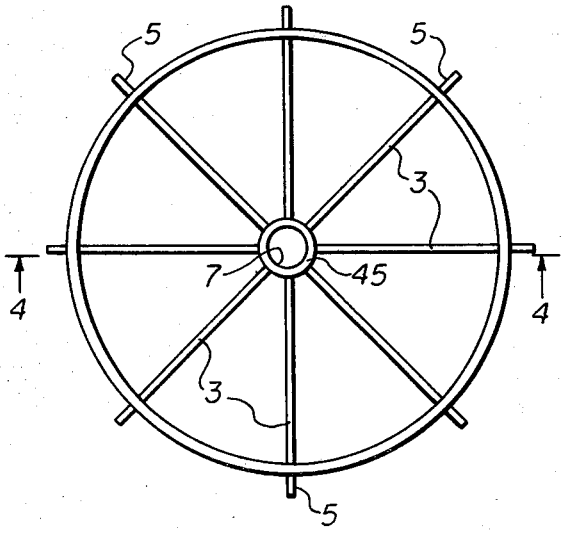
FIG. 3 is a top view of the rib arrangement of the umbrella.

Referring to the drawings, there is shown in FIGS. 1 and 2 an exemplary form of the invention described herein, there being shown in FIG. 2 particularly, and also FIG. 3, the arrangement of a plurality of of intersecting ribs 3 arranged to intersect one another and to project radially from the point of intersection. The ribs

Figure 10:
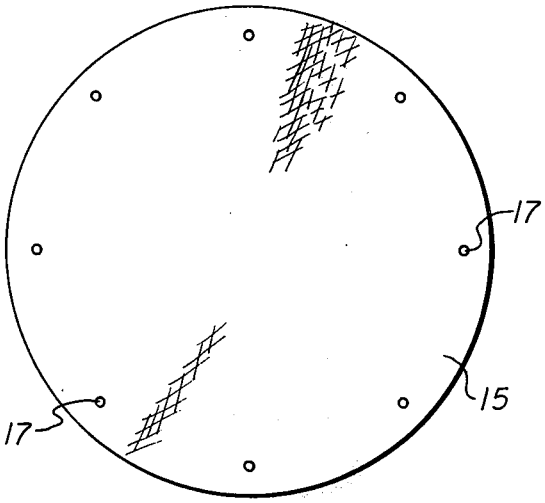
FIG. 10 is a top view of the flexible covering for the frame.
Figure 8:
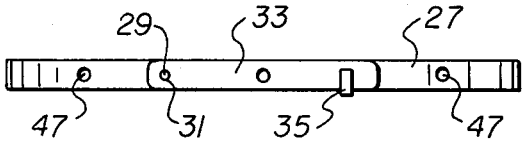
FIG. 8 is a view along the plane 8—8 of FIG. 7.
Figure 7:
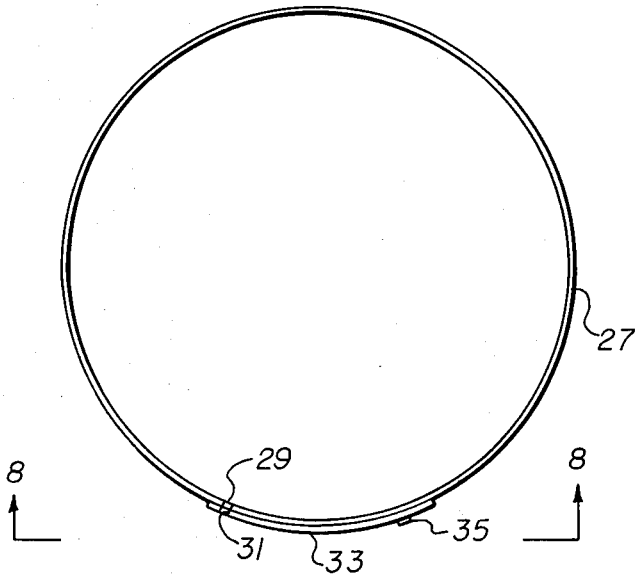
FIG. 7 is a top view of the circumferential belt.
Figure 9:
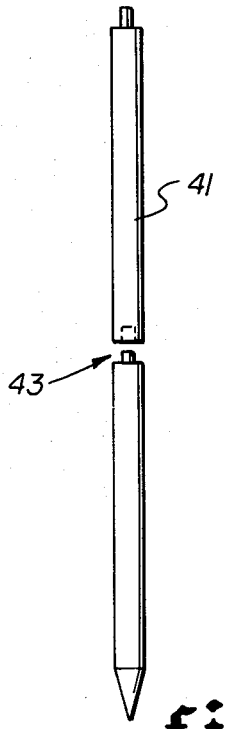
FIG. 9 is an exemplary form of the supporting post of FIG. 1.
Figure 6:
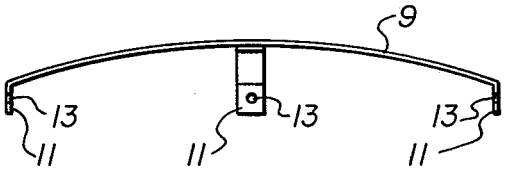
FIG. 6 is a view through the plane 6—6 of FIG. 5.

3 are of equal length and are each characterized by a projecting tip means 5 at each terminal end thereof. The ribs may be formed of extruded plastic or metal, or even wood. The rib cage is characterized by a central frame bore 7 through which the supporting post is intended to protrude. As shown in FIG. 3, the rib cage is characterized by 8 such ribs, but various numbers of ribs may easily be used instead. In order to impart a dish shaped configuration to the apparatus, a plurality of bode cross members 9, each of which having a length less than the diameter of the ribs, is provided. Each of the cross members 9 is characterized by a depending flange 11 having a bore 13 through which the projections 5 of ribs 3 are intended to fit. Thus, the cross members 9 will normally reside in a flat or horizontal configuration rather than the bode configuration of FIG. 6, except when the cross members are positioned and assembled over the projections 5 of the cross ribs. The bode members 9 are disposed with their broad surface in contacting relation to the flexible covering of 15. The flexible covering 15 (see FIG. 10) is characterized by a plurality of reinforced openings 17, each of which is disposed in equidistant manner adjacent the circumference thereof. The positions of the reinforced openings 17 are located so as to coincide with the projections 5 of ribs 3. As shown in FIG. 2, the ribs 3 are disposed with their broad surfaces perpendicular to the broad surface of the bode cross members 9 so as to thereby impart rigidity to the apparatus when it is in the bode, deployed position of FIG. 2. The flexible covering 15 is positioned with its openings 17 over each of the projections 5, there being sufficient tension in the covering, due to its diameter dimension to maintain the flanges 11 of the bode cross members in assembled relation to the projections 5. However, in order to ensure against accidental separation of the bode cross members from the ribs 3, a circumferential belt means 27 is provided, see FIGS. 7 and 8. The belt means 27 includes a projection 29 extending from the surface thereof and adapted to be received within a cooperating opening 31 in a locking handle 33. The locking handle similarly contains a projection 35 adapted to be received within an opening (not shown) of the circumferential belt. Similar forms of a belt connection may be used such as a belt in which the ends thereof overlap one another and are cooperatively engaged by a similar projection-bore connection. The supporting post of 41 may be comprised of two or more sections, this for the purpose of facilitating transportation of the apparatus from one location to another. The components may be readily assembled through use of an appropriate key connection 43 such as is shown in the drawing.

Figure 5:
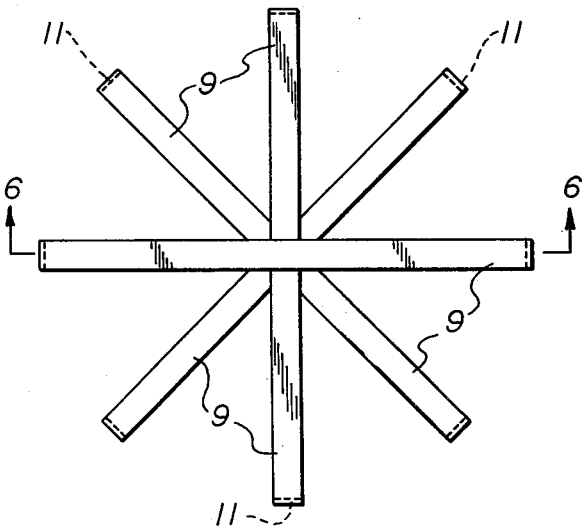
FIG. 5 is a top view of the bowed cross members.

In operation, and assuming that the apparatus is to be assembled and deployed from the aforedescribed component parts, one would first obtain and position the plurality of intersecting radial ribs 3. Although these ribs may be formed in a single integral unit as shown in FIG. 3, they may readily also be assembled from a plurality of individual ribs crossing one another and gripingly engaging one another through a plurality of cooperating slits (not shown). In such case, the supporting post would extend only to the top of the central cup 45, the difference being that the central cup would be characterized by a closure thereover in which the post was received. Thereafter, the first cross member is disposed over a projection at one end of a rib and bent to assume its position over the opposing projection at the other end of such rib. Natural tension in the bode cross member will at least temporarily maintain it in position over the projections. Thereafter, a second rib is disposed in like manner and the rest eventually until all are affixed in the manner described at FIG. 5. The flexible covering 15 is then attached with the first of said openings 17 being positioned over any one of the projections 5. Thereafter, preferably the diametrically opposed opening 17 is attached over the opposing projection on the same rib. Thusly, the sequence is repeated and until each of the openings 17 is engaged by the appropriate adjacent projection. At this time, the circumferential belt is deployed and positioned with each of its openings 47 sequentially over the projections until the belt is fully attached. At such time, the locking handle or other appropriate locking means is secured and the component post 41 assembled and inserted through or into the receptacle cup of 45, the alternative depending upon whether or not the ribs 3 are performed in a single assembly or individually assembled as described above.

Therefore, that which is claimed and desired to be secured by United States Letters Patent is:

1. In a weather protector means adapted to be assembled and disassembled respectively before and after each use thereof from a plurality of component disassembled parts comprising:

a plurality of intersecting ribs extending radially outward from the point of intersection, each of said ribs carrying connection means at the terminal ends thereof, elongate cross members characterized by opposing ends, each end coupled to opposing ones of said connection means at the ends of said ribs, a flexible cover disposed over said cross members and affixed at said connection means and, a circumferential belt engaging each of said connection means for clamping said flexible covering means to the surface of said cross members.

2. The apparatus of claim 1 wherein each of said cross members are longer than the diameter of said ribs so that upon connection of the cross members to the ribs through said connection means there results a bowed configuration in cross section of the cross members.

3. The apparatus of claim 2 wherein said cross members are characterized by a depending flange at each end thereof, each of said flanges including a bore extending therethrough, said connection means including a projection extending outwardly from each end of said ribs and through said bore in each of said depending flanges.

4. The apparatus of claim 3 wherein said circumferential belt includes a plurality of said space openings, said openings engaging the projections on each of said ribs, said circumferential belt further including a plurality of the openings at spaced intervals adapted to receive therethrough said projections so as to fixedly maintain through frictional engagement all of said components in integral relation.

5. The method for assembling a plurality of component parts into a shade apparatus that includes a plurality of crossed ribs having extending projections at each end thereof and a plurality of cross members having openings at the ends thereof for receiving said projections which are to protrude through said openings and into engagement with a circumferential belt maintaining the apparatus in integral relationship comprising the steps of:

positioning said plurality of crossed ribs with the projections thereof extending outwardly in radial manner, positioning the first of said cross members over one of said ribs and inserting the projection of said rib through the opening in the cross member and thereafter inserting the diametrically opposed projection into the opposing opening of the cross member, repeating the last mentioned step until all the cross members are positioned over respective ribs, positioning a covering over said cross members for restraining the transmission of adverse weather conditions, and positioning the circumferential belt about the ribs by inserting the projections through openings in the belt which are spaced for cooperative engagement by each said ribs.

* * * * *